US005101701A

United States Patent [19]

Boldrini et al.

[11] Patent Number: 5,101,701

[45] Date of Patent: Apr. 7, 1992

[54] METHOD OF CHANGING STRIP MATERIAL ON A MANUFACTURING MACHINE

[75] Inventors: Fulvio Boldrini, Ferrara; Lorenzo Cocchi; Antonio Gamberini, both of Bologna, all of Italy

[73] Assignee: G. D. Societa' per Azioni, Bologna, Italy

[21] Appl. No.: 678,591

[22] Filed: Apr. 1, 1991

[30] Foreign Application Priority Data

Apr. 4, 1990 [IT] Italy ..... 03426 A/90

[51] Int. Cl.[5] ..... B65H 19/20; B65H 19/16

[52] U.S. Cl. ..... 83/13; 83/370; 83/649; 83/949; 83/156; 242/57

[58] Field of Search ..... 83/649, 949, 13, 370, 83/156; 242/57, 58.4

[56] References Cited

U.S. PATENT DOCUMENTS 3,925,131 12/1975 Krause ..... 242/58.4 X
4,415,127 11/1983 Scragnol ..... 242/58.4 X
4,481,053 11/1984 Tokumo et al. ..... 242/58.4 X
4,694,714 9/1987 Focke et al. ..... 242/58.4 X

*Primary Examiner*—Douglas D. Watts
*Assistant Examiner*—Kenneth E. Peterson
*Attorney, Agent, or Firm*—Marshall, O'Toole Gerstein, Murray & Bicknell

[57] ABSTRACT

A method of changing a first out-running strip with a new strip on a manufacturing machine having a traction device for feeding the first strip to the machine at a first predetermined speed, and a strip guide located upstream from the traction device; which method provides for stages consisting in cutting the first strip; activating a push device upon the trailing end of the first strip passing through a given point along the strip guide, the push device being engaged by the new strip for feeding the same along the strip guide at a second predetermined speed; controlling the second speed as a function of the first speed, so that the leading portion of the new strip overlaps a corresponding trailing portion of the first strip along the strip guide; and de-activating the push device subsequent to engagement of the new strip by the traction device.

9 Claims, 6 Drawing Sheets

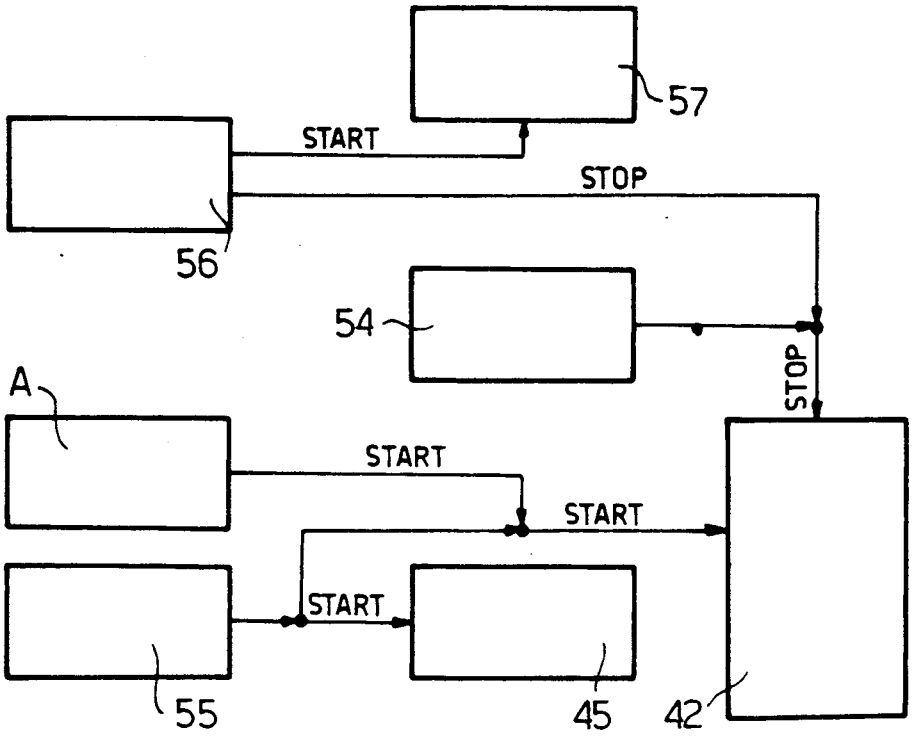
Fig.3
Fig.4
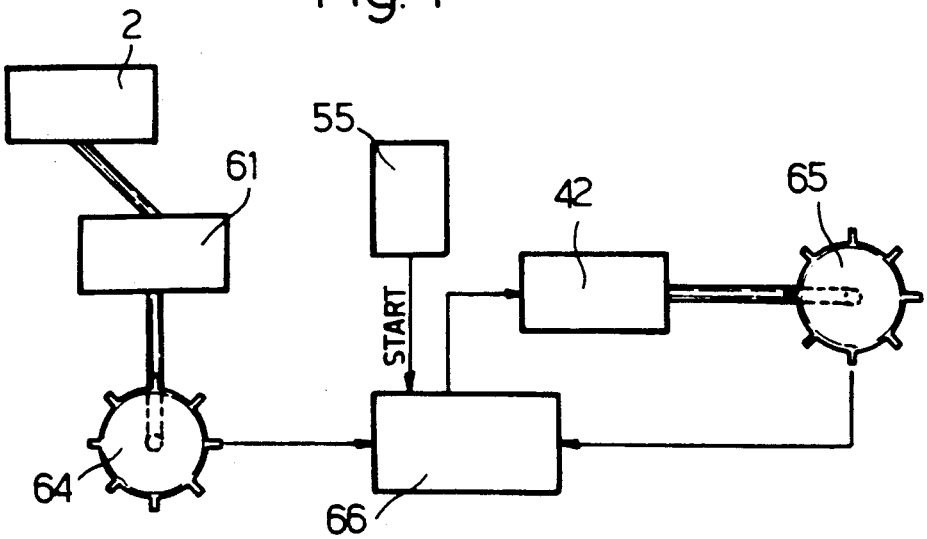

METHOD OF CHANGING STRIP MATERIAL ON A MANUFACTURING MACHINE

BACKGROUND OF THE INVENTION

The present invention relates to a method of changing strip material on a manufacturing machine.

The present invention may be employed to advantage on packing machines in general and, in particular, to cigarette packing machines, to which the following description refers without, however, departing from the wider scope of the present invention.

For special purposes, such as the formation of collars or internal reinforcing elements of flip-top packs, cigarette packing machines are known to employ relatively rigid strip material, normally fed off a reel.

When one reel runs out, the machine is usually stopped for loading a new reel, the leading end of the new strip being connected manually by the operator to the trailing end of the old one.

Such an operation obviously involves considerable down-time and constant supervision of the machine by the operator.

SUMMARY OF THE INVENTION

The aim of the present invention is to provide a method enabling the runout reel to be replaced automatically and, above all, without stopping the machine.

With this aim in view, according to the present invention, there is provided a method of changing strip material on a manufacturing machine comprising traction in-put means for drawing said strip material towards said machine, and guide means for guiding said strip material upstream from said traction means and along a predetermined route, said strip material comprising a first and second strip, and said first strip being engaged by said traction means so as to be fed along said route at a first predetermined speed; said method being characterised by the fact that it comprises stages consisting in cutting said first strip; activating push means, upon detecting the passage of the trailing end of said first strip through a given point along said route, said push means mating with said second strip for feeding the same along said guide means at a second predetermined speed; controlling said second speed as a function of said first speed so that a leading portion of said second strip overlaps a corresponding trailing portion of said first strip along said guide means; and de-activating said push means subsequent to engagement of said leading portion by said traction means.

BRIEF DESCRIPTION OF THE DRAWINGS

A non-limiting embodiment of the present invention will be described by way of example with reference to the accompanying drawings, in which:

FIG. 3 shows a block diagram of the FIG. 1 device;

FIG. 4 shows a block diagram of a device controlling the FIG. 1 device;

DETAILED DESCRIPTION OF THE INVENTION

Figure 1:
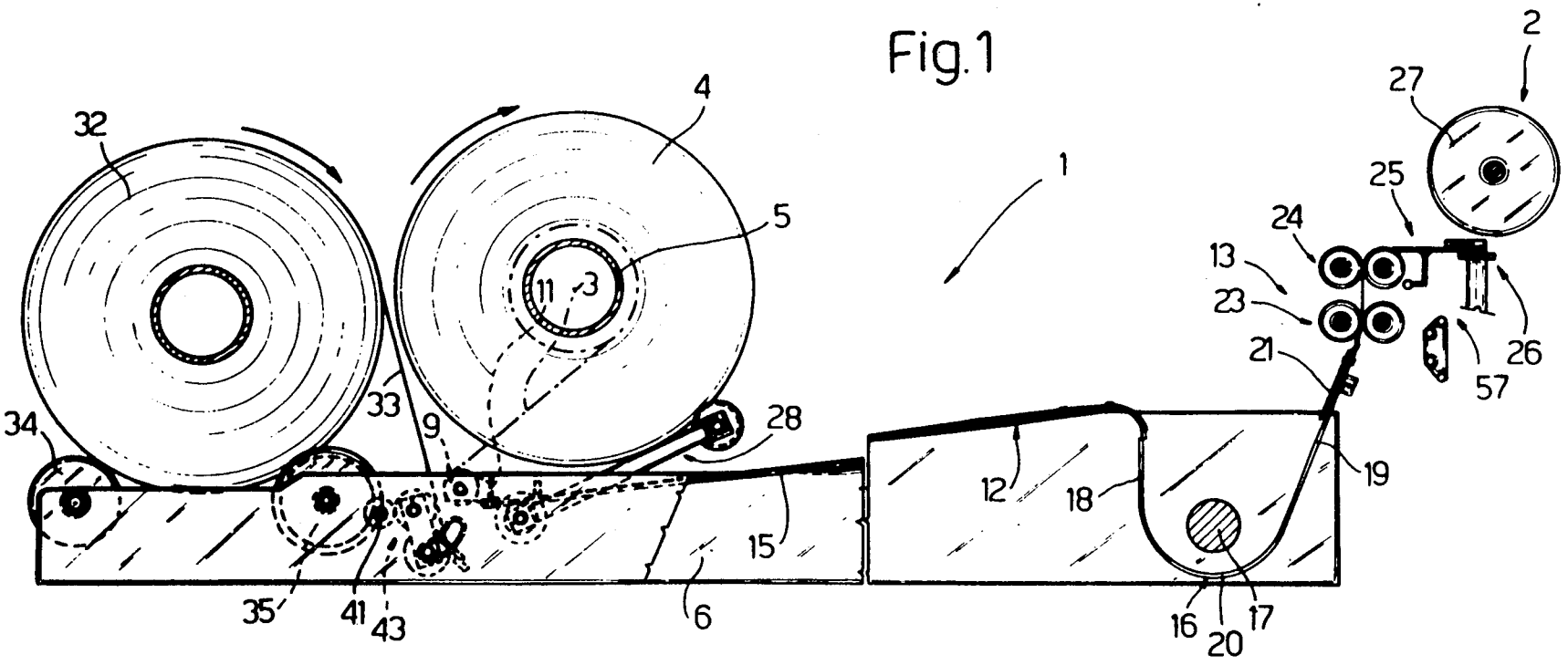
FIG. 1 shows a schematic side view of a device for feeding strip material on to a packing machine implementing the method according to the present invention.
Figure 2:
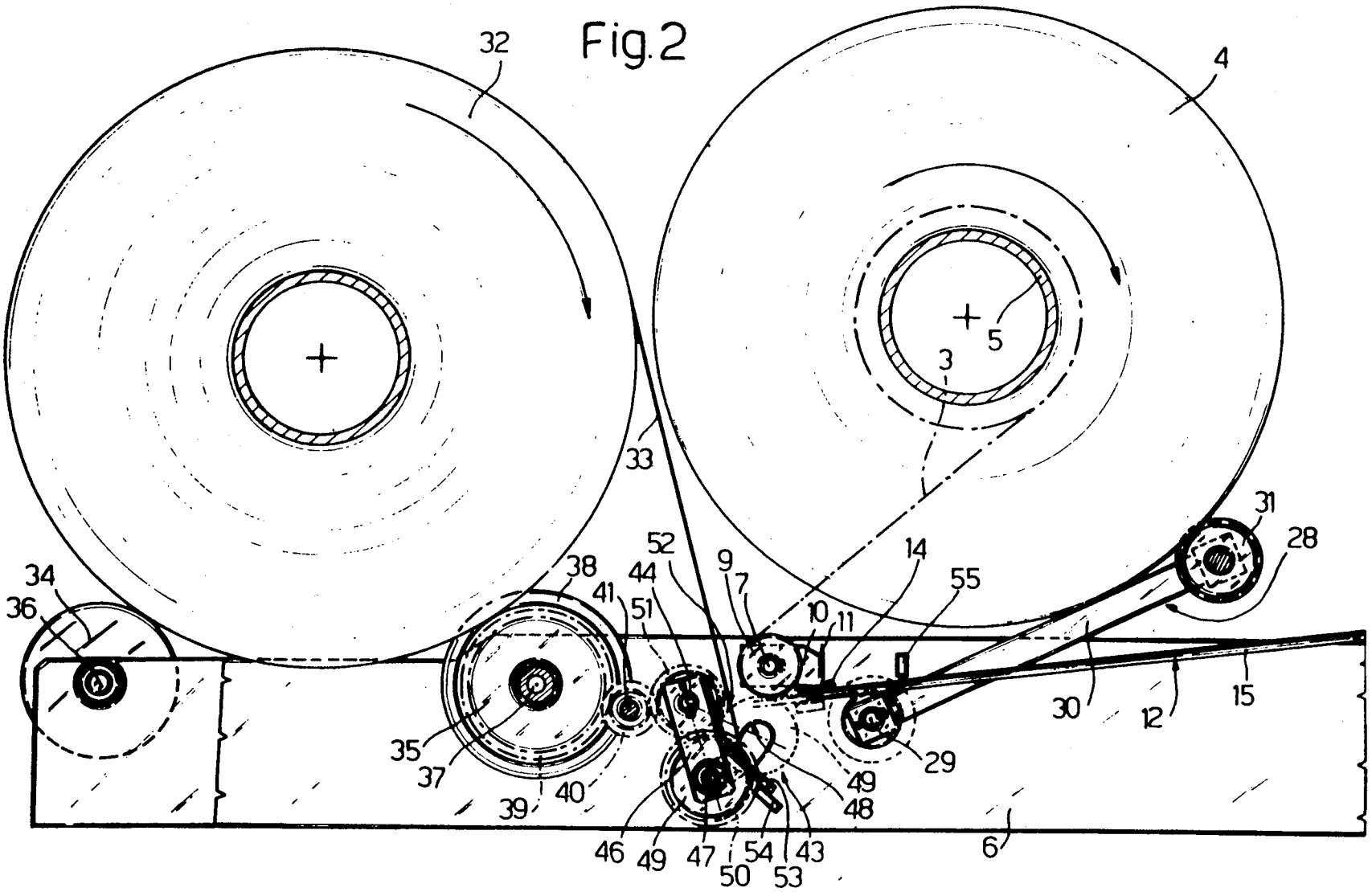
FIG. 2 shows a larger-scale view of a detail in FIG. 1.

Number 1 in FIG. 1 indicates a device for feeding strip material on to a cigarette packing machine 2. In the example shown, said strip material consists of a strip 3 of cardboard or similar (shown by the dot-and-dash line in FIGS. 1 and 2) wound off a reel 4 having a core 5 supported for rotation (clockwise in FIG. 1) on a base 6 in a manner not shown.

Beneath reel 4, base 6 is fitted through with a shaft 7 swung about its axis by actuating means not shown. Shaft 7 supports an idle roller 9, and is fitted with a transverse rod 10 to one end of which is connected a transverse blade 11. Roller 9 is a guide roller about which strip 3 is run prior to engaging a guide 12 extending along base 6 transversely in relation to the axis of shaft 7, and between roller 9 and a traction unit 13 constituting the input of packing machine 2.

Guide 12 presents a substantially C-shaped section with its concave side facing upwards, and presents an initial portion, adjacent to the periphery of roller 9, closed at the top by a transverse blade 14. Guide 12 comprises a first straight portion 15 sloping slightly upwards from roller 9; and a second portion 16 defining a bend having its concave side facing upwards and along which strip 3 is detached from guide 12 and guided by a guide roller 17. Portion 16 of guide 12 comprises a downward input portion 18 and an upward output portion 19 connected by a curved portion 20. The end portion of portion 19 is closed at the top by a transverse blade 21, and terminates immediately below traction unit 13. Traction unit 13 comprises a first and second pair of rollers 23 and 24 powered by the main motor (not shown) of machine 2 for feeding strip 3 along a guide 25 on to a known cutting unit 26, which cuts strip 3 transversely into collars (not shown) picked up successively by a suction wheel 27 at the input to machine 2.

Beneath reel 4, a device 28 provides for detecting at all times the amount of strip 3 left on reel 4. Detecting device 28 comprises a shaft 29 mounted for rotation through base 6 and fitted with a lever 30, the free end of which is fitted in rotary manner with a feeler roller 31 maintained contacting the periphery of reel 4 by flexible means (not shown) located between lever 30 and base 6. On reaching an angular position wherein roller 31 substantially contacts the outer periphery of core 5, shaft 29, via a control not shown and normally consisting of a microswitch, activates the actuating device (not shown) of shaft 7 so as to cut strip 3 transversely via blade 11.

A second reel 32 for a second strip 33, identical to strip 3, is provided on base 6 beside reel 4, and is supported in rotary manner on a saddle defined by two rollers 34 and 35 supported in rotary manner on respective pins 36 and 37 on base 6. Roller 35 is a drive roller having two outer flanges 38 (only one of which is shown) for guiding reel 32 transversely in relation to base 6 as it is rotated (clockwise in FIG. 1).

Roller 35, which turns anticlockwise in FIG. 1, is driven by a gear 39 coaxial and integral with roller 35 and which meshes with a gear 40 on a shaft 41 driven by a motor 42 (FIG. 4). Shaft 41 is supported on base 6 between reels 4 and 32, and is rotated by motor 42 (clock-wise in FIG. 1) at a speed varying as described later on. On the opposite side of shaft 41 in relation to roller 35, base 6 supports a guiding device 43 comprising a further shaft 44 parallel to shaft 7 and which, like shaft 7, is swung about its axis by a known actuating device 45 (FIG. 3). Shaft 44 is fitted with an arm 46, the free end of which is fitted in rotary manner with a pin 47 extending through a curved slot 48 in base 6 and fitted with a roller 49. The length of arm 46 is such that, for each swing of shaft 44 about its axis, pin 47 moves along slot 48 between a lowered idle position and a raised operating position (shown by the dotted line in FIG. 2) wherein roller 49 is located below and pressed contacting roller 9. Pin 47 is fitted with a gear 50 which mates with gear 40 of drive shaft 41 via the interpositon of a gear 51 mounted in idle manner on shaft 44 for rotating roller 49 clockwise in FIG. 1.

The surface of arm 46 facing reel 4 is fitted with a plate 52 extending along arm 46 in the direction of roller 49, and comprising, on its free end, a portion 53 curving outwards of arm 46 and which is fork-shaped for enabling the passage of a peripheral portion of roller 49. The length of plate 52 is such that, when arm 46 is in said operating position, the free end of curved portion 53 is aligned with the inlet of guide 12.

On the end of plate 52 in the lowered position, base 6 presents a sensor 54, the function of which will be described later on. Provision is made for a further sensor 55 over straight portion 15 of guide 12 and, as shown in FIG. 7, a further sensor 56 over guide 25, which consists in known manner of two opposed C sections engaged by the opposite edges of strip 3.

Figure 7:
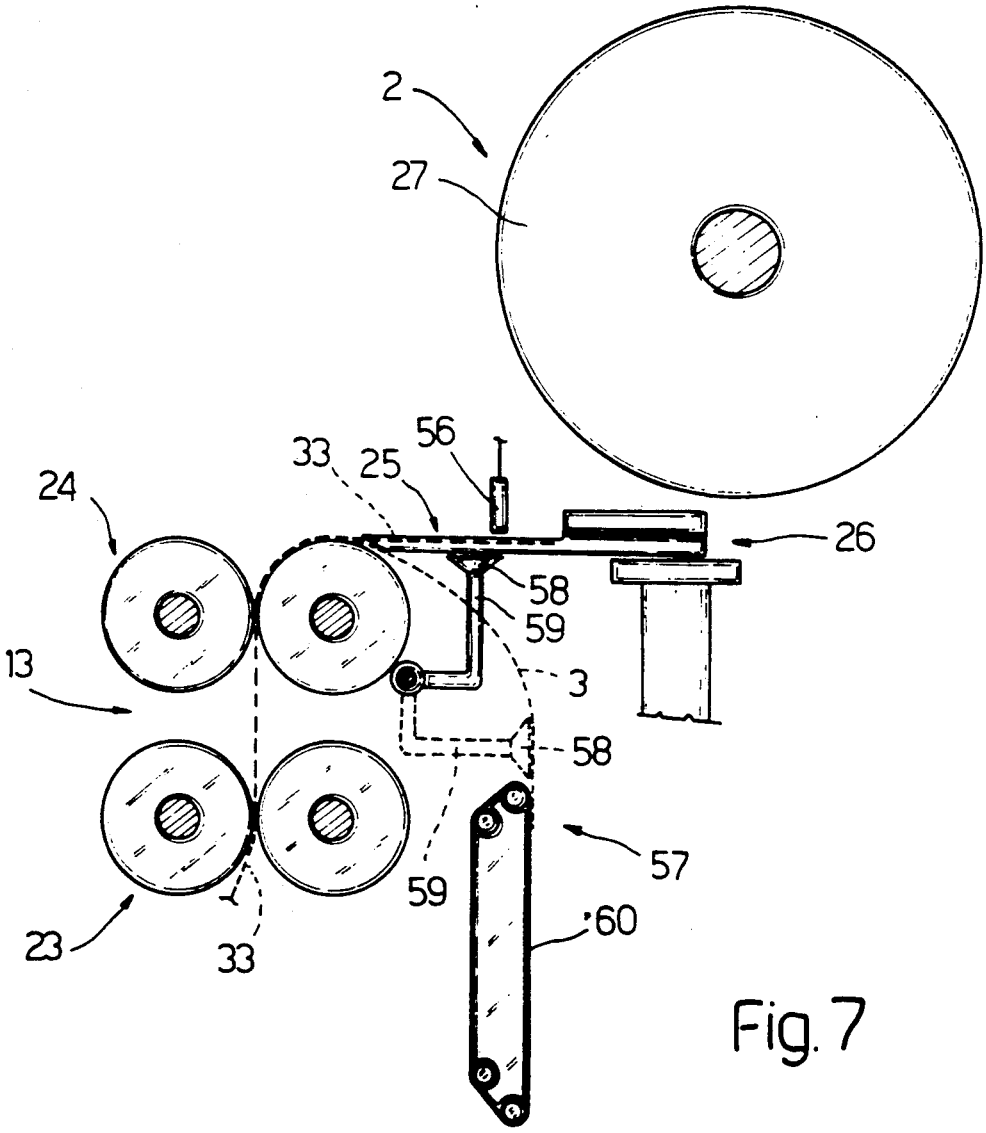
FIGS. 7 and 8 show larger-scale views of two embodiments of a further detail in FIG. 1.

As shown, particularly in FIG. 7, underneath guide 25. provision is made for a disposal device 57 controlled by sensor 56 and comprising a suction cup element 58 on the end of an L-shaped arm 59. Arm 59 is designed to swing about an axis perpendicular to guide 25, so as to move suction cup 58 on to the underside of strip 3, detach strip 3 from said sections of guide 25, and transfer it downwards on to a suction-operated disposal conveyor 60. Under normal operating conditions, strip 3 is reeled off by traction unit 13 powered by the main motor 61 (FIG. 4) of packing machine 2, and is fed about roller 9 into guide 12 and about guide roller 17 at curved portion 16 of guide 12.

Under normal operating conditions, a standby reel 32 is fed in known manner on to rollers 34 and 35, and motor 42 (FIGS. 3 and 4) is started, e.g. by means of manual control A, so as to turn roller 35 and reel off part of strip 33, the leading portion 62 of which (FIGS. 5 and 6) moves down on to plate 52 and beyond the end of curved portion 53 where it is detected by sensor 54, which stops motor 42 leaving strip 33 in the above standby position.

As strip 3 is run off reel 4, feeler roller 31 gradually works its way towards core 5 until, when only a few turns of strip 3 remain on core 5, shaft 29 activates the actuating means (not shown) of blade 11 so as to cut strip 3.

When strip 3 is cut, the trailing portion 63 (FIGS. 5 and 6) travels past sensor 55, which accordingly starts motor 42 and activates actuator 45.

When activated, actuator 45 raises arm 46 so as to align curved portion 53 of plate 52 with the input end of guide 12, bring roller 49 into contact with roller 9, grip leading portion 62 of strip 33 between rollers 49 and 9, and feed the leading end of leading portion 62 of strip 33 to the inlet of guide 12.

At the same time, motor 42 turns reel 32 via roller 35, and feeds strip 33 forward via roller 49 rotated by gears 40, 51 and 50, so as to feed leading portion 62 of strip 33 into guide 12 and along the same towards machine 2.

As shown in FIG. 4, motors 61 and 42 for respectively feeding strips 3 and 33 present respective encoders 64 and 65 for emitting signals respectively proportional to the traveling speed along guide 12 of trailing portion 63 of strip 3 and leading portion 61 of strip 33. Said signals are supplied to a computer 66 which, upon receiving a start signal from sensor 55 corresponding with the passage of the trailing edge of portion 63 of strip 3, measures the distance traveled by strips 3 and 33 and, via a closed-loop circuit, so regulates the speed of motor 42 that leading portion 62 of strip 33 catches up with and at least partially overlaps trailing portion 63 of strip 3 prior to reaching traction unit 13. For example, the speed of strip 33 is maintained higher than that of strip 3 until the former overlaps the latter, after which, both speeds are maintained the same by computer 66.

Figure 6:
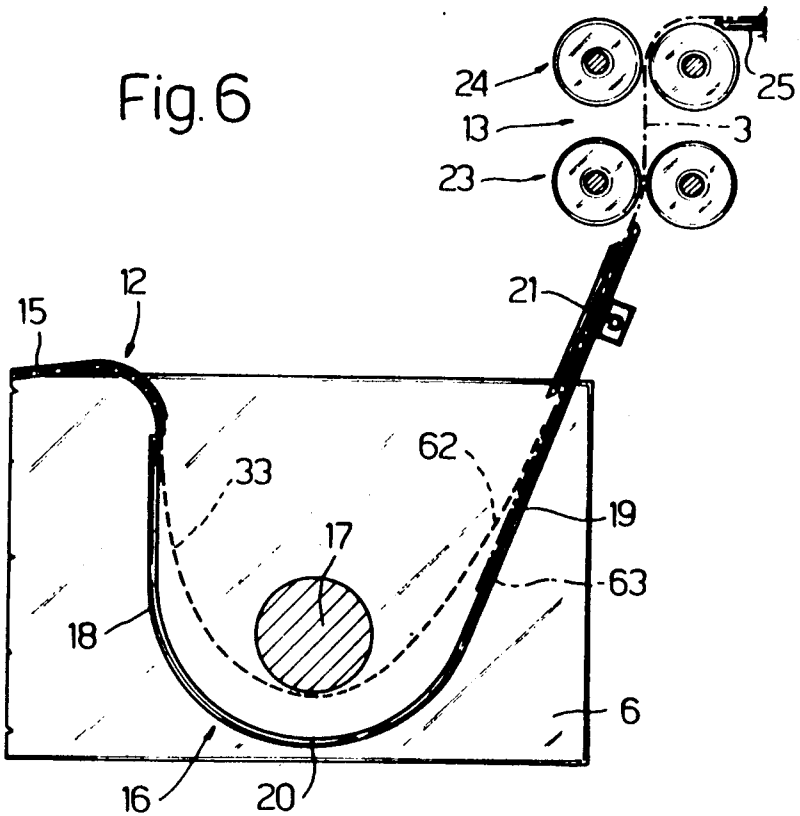
FIGS. 5 and 6 show larger-scale views of two operating stages of the FIG. 1 detail.
Figure 5:
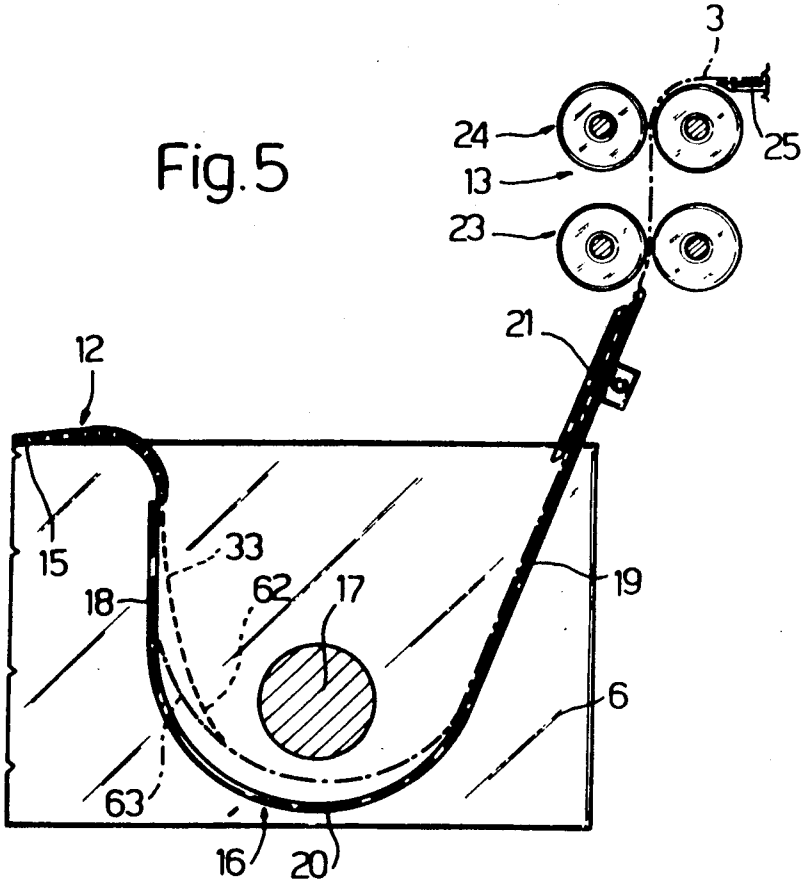

In any case, as shown in FIG. 5, said two speeds are so regulated that leading portion 62 of strip 33 catches up with trailing portion 63 of strip 3 as this travels over the bottom portion of downward portion 18. In this position, in fact, the trailing edge of portion 63 adheres naturally to the surface of guide 12 by virtue of the relative stiffness of strip 3, while the leading edge of portion 62, by virtue of the relative stiffness of strip 33, remains detached from the surface of guide 12, thus enabling troublefree overlapping of portions 62 and 63. Similarly, as shown in FIG. 6, the stiffness of strip 33 ensures the leading edge of overlying leading portion 62 adheres to guide 12 as portion 62 travels along upward portion 19 of portion 16, thus ensuring troublefree insertion of portion 62 beneath blade 21 and into traction unit 13.

As overlapping portions 62 and 63 travel past sensor 56, this emits a signal for arresting motor 42, and at the same time activates disposal device 57, which moves suction cup 58 into contact with underlying trailing portion 63 for extracting the same from guide 25. Once extracted, portion 63 is fed downwards on to suction conveyor 60 by which it is disposed of as it is released from traction unit 13.

Figure 8:
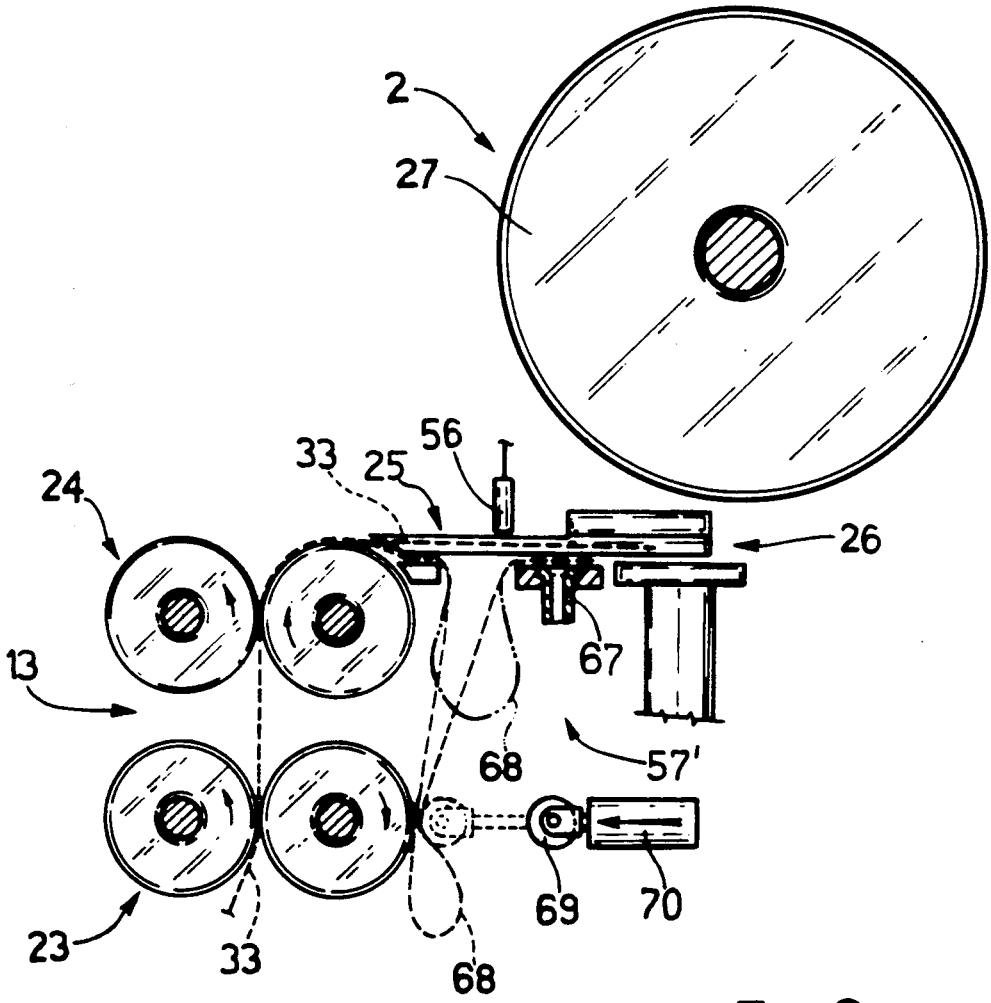

FIG. 8 shows a second embodiment 57' of said disposal device wherein sensor 56 emits a signal for arresting motor 42, and provides for arresting trailing portion 63 by means of a fixed suction cup 67.

When the end of portion 63 is arrested, rotation of the rollers of traction unit 13 results in the formation of a loop 68 which, upon reaching a given size detected by control means not shown, is gripped between a roller 69, operated by an actuator 70, and clockwise-rotating roller 23.

Portion 63 is thus extracted from guide 25 and transferred to collecting means underneath (not shown).

We claim:

1. A method of changing strip material (3, 33) on a manufacturing machine (2) comprising traction input means (13) for drawing said strip material (3, 33) towards said machine (2), and guide means (12) for guiding said strip material (3, 33) upstream from said traction means (13) and along a predetermined route, said strip material (3, 33) comprising a first (3) and second (33) strip, and said first strip (3) being engaged by said traction means (13) so as to be fed along said route at a first predetermined speed; said method being characterised by the fact that it comprises stages consisting in cutting said first strip (3) to create a trailing end; activating push means (9, 49), upon detecting a passage of the trailing end of said first strip (3) through a given point along said route, said push means (9, 49) mating with said second strip (33) for feeding said second strip along said guide means (12) at a second predetermined speed; controlling said second speed at a speed initially higher than said first speed so that a leading portion (62) of said second strip (33) overlaps a corresponding trailing portion (63) of said first strip (3) along said guide means (12); and de-activating said push means (9, 49) subsequent to engagement of said leading portion (62) by said traction means (13).

2. A method as claimed in claim 1, characterised by the fact that it also comprises a further stage consisting in feeding, via a guiding device (43), said leading portion (62) of said second strip (33) to said guide means (12) prior to activating said push means (9, 49).

3. A method as claimed in claim 2, characterised by the fact that said push means (9, 49) comprise a fixed idle roller (9) at an input of said guide means (12), and a drive roller (49) on said guiding device (43); said guiding device (43) being activated for feeding said second strip (33) to said guide means (12) and for gripping said second strip (33) between said idle roller (9) and said drive roller (49) so as to feed said second strip (33) to said push means (9, 49).

4. A method as claimed in claim 2, characterised by the fact that it comprises an initial stage consisting in feeding said leading portion (62) of said second strip (33) into a standby position contacting said guiding device (43).

5. A method as claimed in claim 1, characterised by the fact that said second speed is maintained higher than said first speed over a first portion of said route, and substantially equal to said first speed over the remainder of said route.

6. A method as claimed in claim 1, characterised by the fact that said second speed is maintained higher than said first speed over at least part of said route.

7. A method as claimed in claim 5, characterised by the fact that said leading portion (62) of said second strip (33) follows said trailing portion (63) of said first strip (3) over a first portion (15) of said route; said leading protion (62) and said trailing portion (63) being overlapped over a second portion (16) of said route.

8. A method as claimed in claim 7, characterised by the fact that said second portion (16) of said route comprises a bend having a concave side facing upwards; said leading portion (62) gradually overlapping said trailing portion (63) as they travel around said bend.

9. A method as claimed in claim 1, characterised by the fact that it comprises a further stage consisting in releasing, via disposal means (57 or 57'), said trailing portion (63) of said first strip (3) from said traction means (13) upon said traction means (13) being engaged by said leading portion (62) of said second strip (33).

* * * * *